US007015682B2

(12) United States Patent
Santin et al.

(10) Patent No.: US 7,015,682 B2
(45) Date of Patent: Mar. 21, 2006

(54) CONTROL OF A POWER FACTOR CORRECTED SWITCHING POWER SUPPLY

(75) Inventors: Jose A. Santin, Cypress, TX (US); Md. Masud Reza, Houston, TX (US); Atluri Rama Prasad, Houston, TX (US); Hai N. Nguyen, Spring, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 92 days.

(21) Appl. No.: 10/354,745

(22) Filed: Jan. 30, 2003

(65) Prior Publication Data

US 2004/0150380 A1 Aug. 5, 2004

(51) Int. Cl.
*G05F 1/44* (2006.01)

(52) U.S. Cl. ..... 323/285; 323/222; 323/283

(58) Field of Classification Search ..... 323/222, 323/225, 272, 282, 284, 283, 285
See application file for complete search history.

(56) References Cited

U.S. PATENT DOCUMENTS

| | | | | |
|---|---|---|---|---|
| 4,437,146 | A | 3/1984 | Carpenter | |
| 4,513,361 | A | 4/1985 | Rensink | |
| 4,567,425 | A * | 1/1986 | Bloomer | 323/237 |
| 4,688,162 | A * | 8/1987 | Mutoh et al. | 363/80 |
| 4,695,933 | A | 9/1987 | Nguyen et al. | |
| 4,761,725 | A | 8/1988 | Henze | |
| 5,475,296 | A | 12/1995 | Vinsant et al. | |
| 5,495,164 | A | 2/1996 | Heng | |
| 5,631,550 | A | 5/1997 | Castro et al. | |
| 5,847,942 | A | 12/1998 | Bazinet et al. | |
| 5,861,734 | A | 1/1999 | Fasullo et al. | |
| 5,877,610 | A | 3/1999 | Copple | |
| 5,933,336 | A | 8/1999 | Jiang et al. | |
| 6,005,377 | A | 12/1999 | Chen et al. | |
| 6,043,633 | A * | 3/2000 | Lev et al. | 323/222 |
| 6,091,233 | A | 7/2000 | Hwang et al. | |
| 6,178,101 | B1 | 1/2001 | Shires | |
| 6,225,795 | B1 * | 5/2001 | Stratakos et al. | 323/283 |
| 6,229,288 | B1 | 5/2001 | Baretich et al. | |
| 6,259,614 | B1 | 7/2001 | Ribarich et al. | |
| 6,282,109 | B1 * | 8/2001 | Fraidlin et al. | 363/89 |
| 6,373,734 | B1 | 4/2002 | Martinelli | |
| 2001/0035744 | A1 | 11/2001 | Chen | |
| 2002/0024328 | A1 | 2/2002 | Balakrishnan et al. | |
| 2002/0057080 | A1 | 5/2002 | Telefus et al. | |
| 2002/0118001 | A1 * | 8/2002 | Duffy et al. | 323/283 |
| 2004/0047166 | A1 * | 3/2004 | Lopez-Santillana et al. | 363/89 |

* cited by examiner

*Primary Examiner*—Gary L Laxton

(57) ABSTRACT

The specification may disclose a switching power supply operated in a discontinuous current power factor corrected mode, having multiple boost circuits or boost modules, and controlled by a digital signal processor. The digital signal processor may implement a control scheme whereby the duty cycle of the switching signals applied to the boost modules may be controlled, in part, by the amount of power delivered to the load in the previous half cycle of the source voltage. In another aspect, an output voltage correction to the switching signals may be applied at the end of each half cycle, which may result in voltage correction at twice the source frequency.

23 Claims, 3 Drawing Sheets

CONTROL OF A POWER FACTOR CORRECTED SWITCHING POWER SUPPLY

BACKGROUND

In a switching power supply, an alternating current (AC) power signal delivered from a source may be full wave rectified by a full wave bridge to create a direct current (DC) signal having a ripple at twice the frequency of the source. The full wave rectified signal may be referred to as the input voltage $V_{i_{rect}}$, and may couple to a first terminal of a boost inductor. The second terminal of the boost inductor of the boost circuit may couple to a boost switch and a boost diode. A boost circuit, which may comprise the boost inductor boost switch and boost diode, may have two distinct phases of operation: an inductor charge cycle, and an inductor discharge cycle.

During the inductor charge cycle, the boost switch may be closed (placed in a conductive state) thereby allowing electrical current to flow through the boost inductor, the boost switch, and then to ground. As the current through the boost inductor increases, energy may be stored in the magnetic field of the boost inductor. When sufficient energy is stored in the boost inductor, the boost switch may open, and the second phase of operation, the inductor discharge cycle, may begin. The collapsing magnetic field of the boost inductor in the discharge cycle may create a voltage which forward-biases the boost diode, allowing current to flow through the boost diode to a load $R_L$.

Although it may be possible to utilize a boost circuit without regard to power factor of a source, it may be desirable that the electrical current waveform drawn from the source substantially match the voltage waveform of the source—power factor control. Having the electrical current drawn from the source match the voltage waveform may be accomplished by pulse-width modulating a control signal applied to the boost switch. As the source voltage increases or decreases, so too does the current draw. To accomplish this, control changes may be made based on source voltage. The output voltage too may need to be monitored and controlled. Thus, there may be two distinct control loops for control of a boost circuit—a power factor control loop (which may also be referred to as a current loop) and a voltage output control loop.

With regard to power factor or current loop control, this first "loop" may involve a comparison of the input voltage $V_{i_{rect}}$ to the total input current $I_i$ (including inductor charge current not supplied to the load). Signals representing the input voltage and the current may be subtracted to create an error signal. The current control loop may be a very fast loop, meaning that control changes may be made at a frequency significantly higher than a ripple frequency in the rectified source waveform. In order to achieve the power factor correction in continuous current mode systems, adjustments to the duty cycle of the pulse width modulated waveform may be made at approximately the same frequency as the switching frequency. Continuous current mode systems may not allow boost inductor current to drop to zero before alternating to an inductor charge cycle, which may again increase current flow. By contrast, systems that operate in discontinuous current mode may be designed to allow boost inductor current to drop to zero before again entering an inductor charge cycle. With the switching frequency ranging from 50 to 100 kilohertz, corrections applied by the current loop may take place at the same frequency. The signal generated by the current loop may be applied to a pulse width modulator, which in turn may create and modify the duty cycle of the signal applied to the boost switch.

The second controlled parameter in a boost circuit may be the DC output voltage $V_O$. Since the controllable variables may be the frequency and duty cycle of the signal applied to the boost switch 10, there may be overlap of control between the current loop previously discussed and the voltage loop. The voltage control loop may comprise a reference voltage $V_{REF}$, which may represent the desired output voltage summed with the actual output voltage $V_O$. So that the voltage control loop does not become unstable due to the interaction of the two control loops, it may be necessary that the loop be sufficiently slow, or have a low bandwidth, that reactions to the ripple in the output voltage related to the ripple (AC component) of the input voltage may not be made instantaneously. Stated otherwise, if the voltage loop attempts to apply corrections near the frequency of the ripple current, the loop may become unstable. In order to address this factor, voltage control loops may have limited bandwidth and therefore control tolerances for output voltage during load transient conditions may be very wide. In analog systems, a limited bandwidth may be accomplished by a low pass filter coupled between the sensed output voltage $V_O$ and a circuit where the reference signal and the sensed output voltage are summed. The low pass filter, as the name implies, may allow only the lower frequency signals to pass, and the signals passed may be below ripple frequency. The summation of the reference signal and the low pass filtered output voltage may create an error signal which may be applied to proportional and integral components of the control loop. The output of the voltage control loop may be summed with an output of an input current control loop to create the signal to the pulse width modulation system.

Analyzing the two loops in parallel, the current loop may make the primary determination as to the duty cycle of the pulse width modulated signal for power factor correction purposes, and the voltage loop, on a much slower basis, may make corrections to maintain the set point output voltage. Again, the limited bandwidth voltage control loop may lead to large output voltage swings, especially in transient conditions.

The control loops described may be implemented in analog format with control parameters (e.g. loop gain) fixed by resistors and capacitors. Component tolerances and variations in manufacturing, as well as aging of the circuit components, may result in changes over time to the control loop response. The control loops described may likewise be implemented in digital systems, but this may merely implement the analog control loops in digital form.

Implementation of control loops for switching power supplies, whether in analog or digital format, may require measuring total input current, which may comprise electrical current supplied to the load and boost inductor charge current (which may not be supplied to the load). Measuring current may be difficult and/or require significant space within the power supply. Further still, the analog control systems may assume a sinusoidal input waveform, and thus line disturbances that may affect the sinusoidal character of the input voltage may adversely affect the voltage output control loops.

Some switching power supplies may implement multiple boost circuits, each switched slightly out of place with the others. While switching power supplies with multiple boost circuits may be useful for reducing ripple in the output voltage, their advantage may be lost when the power supply is in a lightly loaded condition. Boost circuits may be most efficient, in terms of power lost within the circuit compared to power delivered to the load, when operating at almost peak capacity. In situations where multiple boost circuits are used, and the power to be supplied is significantly less than the rated capacity, efficiency of the switching power supply boost circuit may drop significantly. Moreover, off-the-shelf boost circuit controllers may not be capable of producing the multiple phase-shifted control signals to the boost switches in a multi-phase system.

BRIEF DESCRIPTION OF THE DRAWINGS

For a detailed description of embodiments of the invention, reference will now be made to the accompanying drawings in which.

NOTATION AND NOMENCLATURE

Certain terms are used throughout the following description and claims to refer to particular system components. As one skilled in the art will appreciate, computer companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . ".

Also, the term "couple" or "couples" is intended to mean either an indirect or direct electrical connection. Thus, if a first device couples to a second device, that connection may be through a direct electrical connection, or through an indirect electrical connection via other devices and connections.

DETAILED DESCRIPTION OF EMBODIMENTS OF THE INVENTION

The following discussion is directed to various embodiments of the invention. Although one or more of these embodiments may be preferred, the embodiments disclosed should not be interpreted or otherwise used as limiting the scope of the disclosure, including the claims, unless otherwise specified. In addition, the following description has broad application, and the discussion of the embodiments is meant only to be exemplary, and not intended to intimate that the scope of the disclosure, including the claims, is limited to these embodiments.

Figure 1:
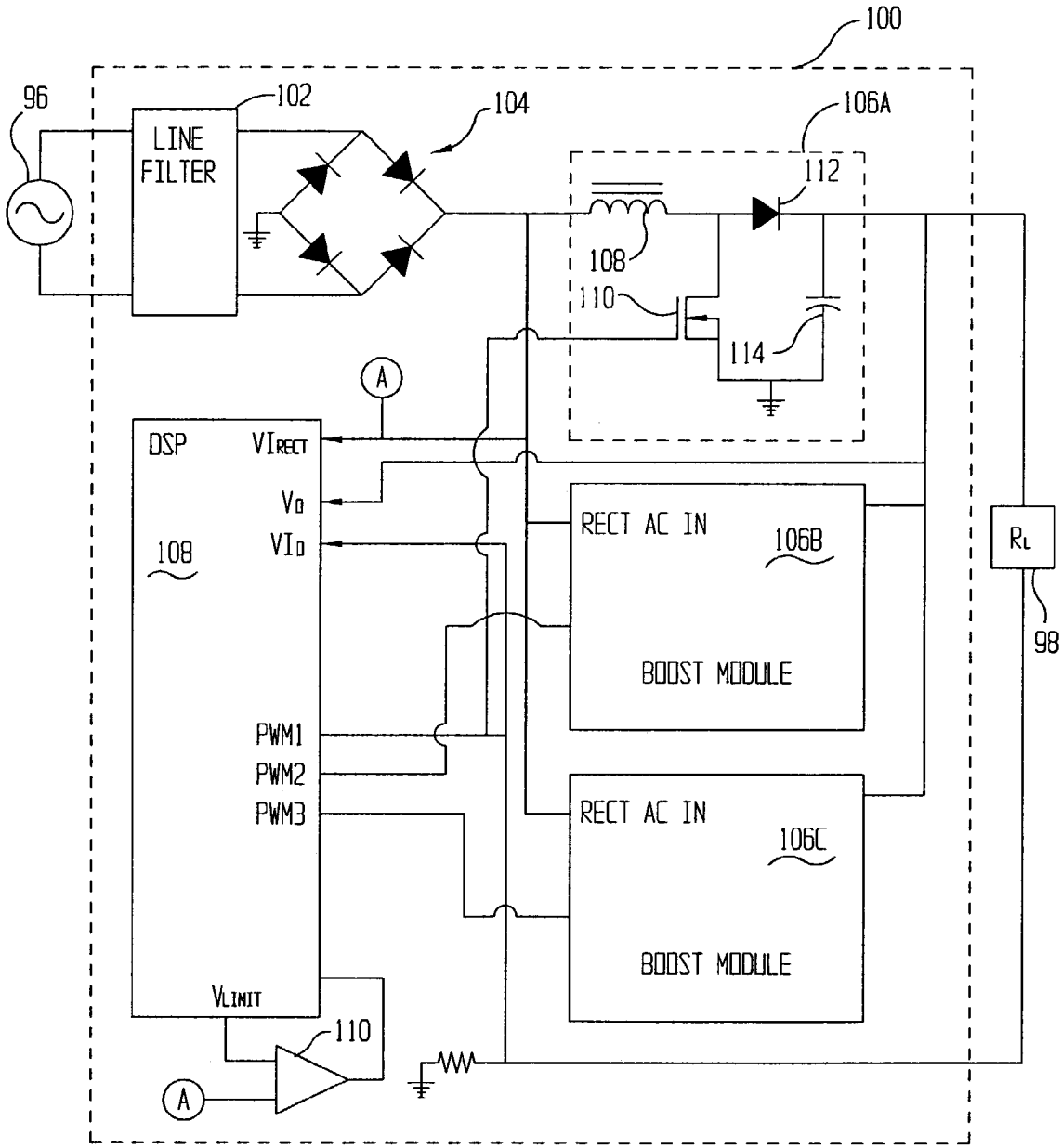
FIG. 1 illustrates a switching power supply in accordance with embodiments of the invention.

Referring initially to FIG. 1, switching power supply 100 may couple on its input terminals to a source 96 which may provide alternating current (AC) power. Although the embodiments of the Invention are not limited to use with any particular power source, some sources 96 may range from 120 volts root mean square (RMS) in the United States, to 220 volts RMS in Europe and Asia. Moreover, some countries may operate at 60 Hertz, and yet others operate at 50 Hertz. The power supply 100 may couple at its output terminals to a load $R_L$ 98 which may utilize direct current (DC) power. In some embodiments of the invention, the load $R_L$ is a computer system; however, the systems and methods described in this specification may be operable independent of the particular load.

The power supply 100 may comprise a line filter 102, which may be designed to not only filter noise in the signal propagating from the source 96, but may also act to filter noise generated by the power supply 100. The line filter 102 may couple on its output terminals to a rectifying bridge 104. The rectifying bridge 104 may convert the AC power signal delivered from the source 96 into a DC signal having a ripple at twice the frequency of the source 96. If the input to the power supply 100 is 120 volt AC RMS signal at 60 Hertz, the output of the rectifying bridge 104 may be a DC signal having a 120 Hertz ripple and a peak voltage of approximately 170 volts. The DC signal may thereafter be applied to a plurality of boost circuits or modules 106. FIG. 1 illustrates three such boost modules 106; however, depending on the amount of power required by the load $R_L$, any number of boost modules 106 may be employed. The internal schematic of boost module 106A may be exemplary of the various components in all the boost modules 106.

Each boost module may comprise a boost inductor 108 having its downstream terminal coupled to a boost switch 110 and a boost diode 112. A switching signal may be applied to the gate of the boost switch 110, the signal having a switching frequency and a duty cycle, which may control the amount of time within each switching period that the switch 110 may be conductive. When conducting, the boost switch 110 may allow current to flow through the inductor 108, which may store energy in the magnetic field of the inductor. When the boost switch 110 is not conducting or is turned off, collapsing magnetic field of the inductor 108 may generate a voltage on its downstream terminal that may forward-bias the boost diode 112, and may provide electrical current to the capacitor 114 and load $R_L$. The alternative charging and discharging of the inductor 108 may take place many times within each half cycle of the source voltage 96.

Figure 2:
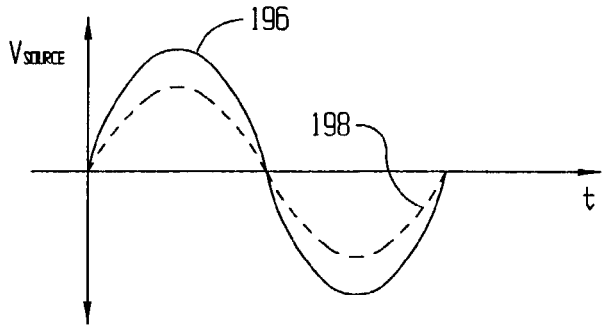
FIG. 2 illustrates a voltage waveform that may be produced by the voltage source of FIG. 1.

In at least some of the embodiments of the invention, the switching power supply 100 may be operated in a power factor corrected (PFC) mode. In PFC mode, current drawn from the source 96 may have approximately the same waveform as the voltage of the source 96. FIG. 2 illustrates a waveform 196 of the voltage supplied by the source 96. FIG. 2 also illustrates, by dashed line 198, that an input current waveform in a power factor corrected power supply may be substantially the same as the waveform of the input voltage $V_{source}$. It should be understood that the current shown by line 198 in FIG. 2 is idealized in the sense that, because of the boost circuit operation, the current waveform is jagged or has a saw tooth shape, with the peaks possibly defining line 198. After rectification by the bridge 104, the input voltage $V_{i_{rect}}$ may be exemplified by the solid line in FIG. 3. In a switching power supply having only a single boost circuit or module, the jagged waveform may be fairly pronounced, especially in a discontinuous current mode. In at least some of the embodiments of the invention, however, the magnitude of input harmonics and harmonics on the output capacitors 114 created by the boost circuit may be reduced by operating multiple boost modules 106, with the switching signal applied to each boost module slightly out of phase. The switching power supply 100 may be operated in a discontinuous current mode, meaning that within each half cycle of the input voltage, such as half cycle 200 of FIG. 3, the current through the boost inductor 108 may be allowed to reach zero before the boost switch 110 begins the charging cycle.

Figure 3:
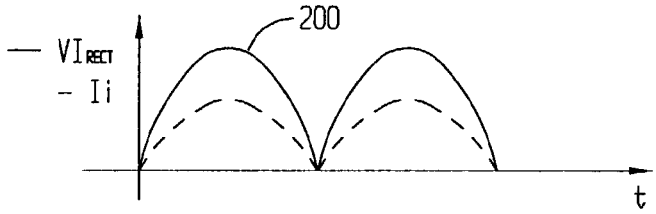
FIG. 3 illustrates a rectified voltage waveform, and a corresponding power factor corrected current, in accordance with embodiments of the invention.
Figure 4:
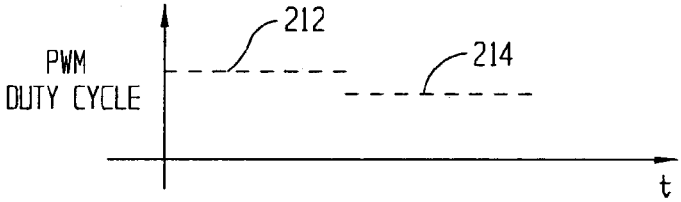
FIG. 4 illustrates the relationship between input voltage and duty cycle in accordance with embodiments of the invention.

To operate a power factor corrected switching power supply, such as power supply 100, in discontinuous current mode, the duty cycle of the pulse width modulated signal applied to the boost switch 110 within each boost module 106 may remain constant within each half cycle. FIG. 4, plotted on the same time scales as FIGS. 2 and 3, illustrates duty cycle adjustments in each half cycle, in accordance with embodiments of the invention. In particular, the dashed lines of FIG. 4 may exemplify that the duty cycle may change from half cycle to half cycle. As discussed more fully below, if output voltage is low, the duty cycle may be higher across a next half cycle, as exemplified by dashed line 212. Likewise, if output voltage is high, the duty cycle may be lower across the half cycle, as exemplified by dashed line 214.

Figure 5A:
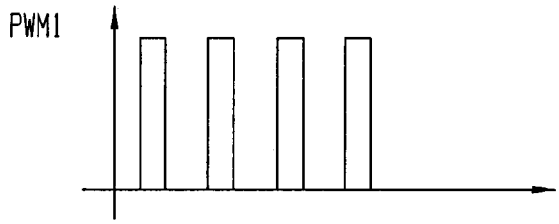
FIGS. 5A–C illustrate switching signals that may be applied to boost circuits in accordance with embodiments of the invention.
Figure 5B:
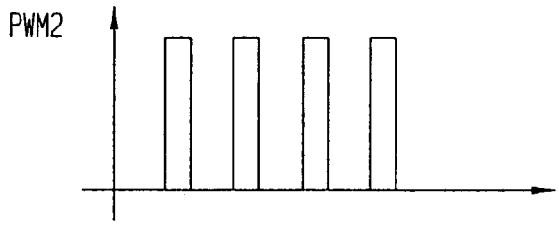
Figure 5C:
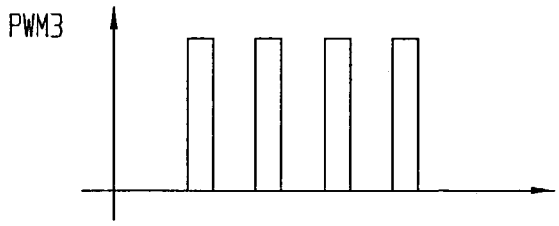

In order to reduce the high frequency ripple components in the output voltage and input current, and also to utilize more common and less expensive components even as power supply capability increases, at least some of the various embodiments may use a plurality of boost modules 106 to perform the boost operation for the power supply 100. While three such boost modules 106 are illustrated in FIG. 1, any number may be provided. To reduce harmonic distortion, at least some of the embodiments phase shift the switching signals supplied to each of the boost modules 106. FIGS. 5A–C illustrate a set of switching signals that may be applied to the boost modules 106A–106C. The waveforms of FIGS. 5A–C illustrate that the switching signal applied to each module, while having the same overall waveform, may be shifted in time (which is equivalent to saying shifted in phase), such that the saw tooth shaped current drawn from the source may be spread out over time and reduced in amplitude to reduce the harmonic distortion. Thus, for example, the switching waveform of FIG. 5A could be applied to boost circuit 106A, the switching waveform of FIG. 5B could be applied to the boost circuit 106B, and the switching waveform of FIG. 5C could be applied to the boost circuit 106C.

Each boost module 106 may have an internal power loss that may be present regardless of the amount of actual power delivered through the particular module. Thus, the more power that can be delivered through a single module 106, the greater the efficiency of the particular module, and therefore the overall power supply. In at lease some embodiments of the invention, a digital signal processor 108 (FIG. 1) may monitor the total amount of power delivered to the load $R_L$, and may further have the ability to selectively utilize the boost modules 106 based on total power delivered. More particularly, if the power supply 100 operates at relatively low power, meaning that the load $R_L$ is not drawing as much power as the power supply is capable of delivering, the digital signal processor 108 may use a number of boost modules 106 that provides a higher efficiency than using all available boost modules. Thus, at low loads, only a single boost module 106 may be in operation. At high loads, all the boost modules within the switching power supply 100 may be in operation. By selectively utilizing the boost modules 106, the power supply 100 may be kept at or near its optimum efficiency. It is noted that as the number of boost modules decreases, the digital signal processor 108 may adjust the phase relationship of the switching signals applied to the boost modules in use.

Figure 6:
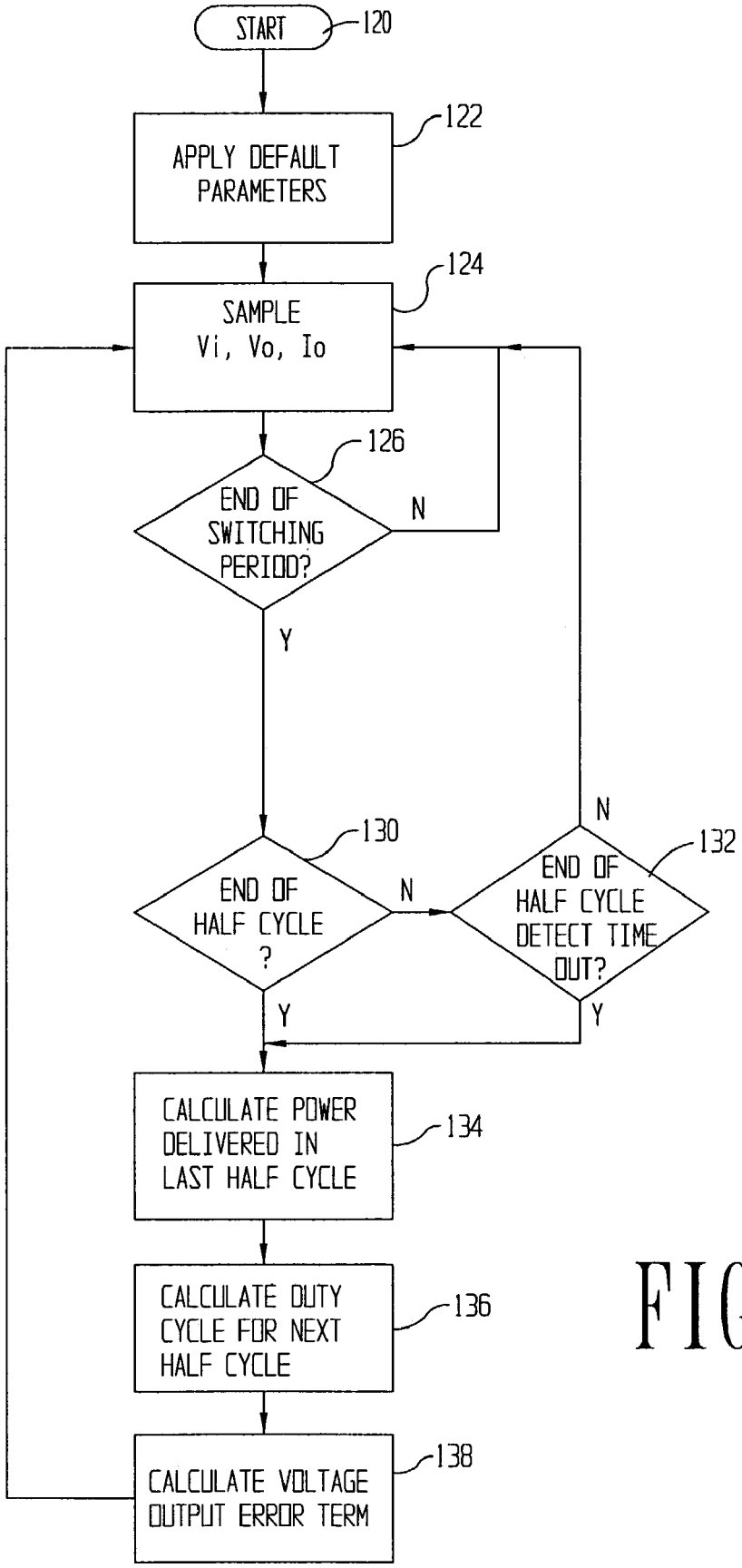
FIG. 6 illustrates a flow diagram of a control scheme that may be implemented in accordance with embodiments of the invention.

The digital signal processor 108 may be responsible for implementing the control loops for the switching power supply 100 to implement power factor correction and voltage control for the voltage supplied to the load $R_L$. FIG. 6 illustrates a flow diagram for a control system in a discontinuous mode that may be implemented within the digital signal processor 108. In particular, the process may start at block 120, and the initial step may be application of default control parameters (block 122). The digital signal processor 108 may sample the rectified input voltage $V_{i_{rect}}$, the output voltage $V_o$ and the output current $I_o$ (block 124), and may make a determination as to whether an end of the switching period (input voltage waveform zero crossing or half cycle) has been reached (block 126 ). The combination of blocks 124 and 126 exemplify that the input voltage, output voltage and output current may be sampled faster than the switching frequency, which switch frequency may be 150 kilohertz; however, speed of the analog to digital conversion within the DSP 108 may limit this ability such that samples may be taken at a rate slower than the switching frequency. If the end of the half cycle has not been reached, the process may return to block 124, where again the various parameters are sampled. If, however, the end of the half cycle has been reached, for discontinuous current mode systems the DSP 108 may calculate a RMS value for each of the input voltage, output voltage and output current. Using these calculated values, the process may calculate a duty cycle for the next half cycle of input voltage based in part on maintaining output voltage. The next step may be a determination of whether an end of cycle (a zero crossing of the source voltage 96) has been reached (block 130). If the end of the half cycle has not been reached, it may be that the control loop operation is still within a half cycle, in which case process may return to block 124. However, if an end of cycle is not reached within a predetermined amount of time after the end of cycle should have been detected (block 132), embodiments of the invention may assume non-periodic or DC input voltage waveform, and force an end of cycle and move to block 134 rather than returning to the sampling block 124.

One of the parameters that may affect the duty cycle of the switching signal is the amount of power delivered in the last half cycle. As has been alluded to above, in at least some embodiments of the invention the digital signal processor 108 samples the output voltage and the output current. Across each half cycle of the source voltage 96, the DSP 108 may calculate an average output voltage $V_o$, an average output current $I_o$, and using these calculated averages an output power delivered. Control loop operation over a subsequent half cycle may be controlled, in part, by the amount of power delivered in the previous half cycle. Referring again briefly to FIG. 4, the amount of power delivered in a previous half cycle may affect the duty cycle of the switching signal applied to the boost modules 106 such that if excess power was drawn by the load in the previous half cycle, the duty cycle may be increased during a subsequent half cycle to replace the power (see FIG. 4, for example line 212). Likewise, if the power required by the load during the last half cycle was less than anticipated, then the duty cycle for a subsequent half cycle may be correspondingly shorter (see FIG. 4, for example line 214). After the power delivered in the last half cycle is calculated, a duty cycle may be calculated using the power of the last half cycle as a control parameter (block 136). The second parameter that controls, in part, the duty cycle of the switching signal applied may be an output voltage error term. In various embodiments of the invention the DSP 108 may apply a voltage error correction term at each end of half cycle when the duty cycle value is calculated. Thus, the final step may be the calculation of the voltage error constant (block 138).

Blocks 136 and 138 of FIG. 6 illustrate the calculation of, or the use of, a curve or equation for determining the duty cycle of the switching signal applied to the boost modules 106. Equation 1 below illustrates one such curve or equation; however, many others may be used.

$$T_{on} = \frac{2\cdot(V_{o_{avg}} I_{o_{avg}})\cdot K_{vi}\cdot n\cdot L}{\alpha V_{i_{rms}}^2} + [(V_{setpoint} - V_{o_{avg}}) * K_1] \quad (1)$$

where $T_{on}$ may be the on-time of the control switching signal in each cycle of the switching period, $V_{o_{avg}}$ may be the average output voltage for the last half cycle of the source, $I_{o_{avg}}$ may be the average output current for the last half cycle of the source, $K_{vi}$ may be a constant based on the measured RMS value of the source during the previous half cycle of $V_{i_{rms}}$ (e.g., $K_{vi}$ may have a first value when the source is a 120 Volt RMS source, and a second value when the source is a 220 Volt RMS source), n may be a number of boost modules in operation, L may be value of a boost inductor in each boost module, $V_{i_{rms}}$ may be the RMS value over the last half cycle of the source of the $V_{i_{rect}}$ signal, $V_{setpoint}$ may be the setpoint voltage for the output power, $K_1$ may be a tuning constant, and where $\alpha$ may be an efficiency factor of switching power supply.

Equation (1) above exemplifies a control strategy that may be implemented in the various embodiments. In particular, the first portion of the equation, containing the $\alpha$ term exemplifies a control strategy where duty cycle of the switching frequency for each of the boost modules is controlled as a function of the amount of power delivered to the load in the previous half cycle of the source. If a greater amount of power is delivered in the previous half cycle, the on-time (or correspondingly the duty cycle) increases such that that power is replaced in the subsequent half cycle. Likewise, if the amount of power drawn by the load in the previous half cycle was lower than expected, equation (1) above may dictate that the duty cycle decrease, as not as much power may be needed. Equation (1) also exemplifies that in the various embodiments of the invention, output voltage control may be adjusted at twice the frequency of the source. In particular, the pardon of equation (1) in brackets contributes to the determination of the on-time. The $V_{o_{avg}}$ may be the average output voltage for the last half cycle, and therefore the bracketed term may make voltage control changes in the duty cycle each half cycle of the source. Thus, both the power control portion and the voltage output control portion of equation (1) are updated each half cycle, or at twice the frequency of the source 4. It is noted that the various embodiments of the invention do not measure input current; rather, input current is calculated during the charge and discharge cycles of the inductors using the instantaneous values of the rectified input voltage and the known relationship of voltage across an inductor to its current flow.

The various control parameters, such as the rectified input voltage, the output voltage and the output current, may be sampled as often as the performance of the digital signal processor 108 allows; however, the sampling of the input voltage may be aligned with particular times in the switching frequency. More particularly, high transient currents and high transient voltages may be experienced in the rectified AC input line, downstream of the full wave bridge 104, at times when inductors are transitioning into their charging cycles, or transitioning into their discharging cycles. In order that the sampled input voltage is not unduly affected by the voltage and current transients caused by the boost circuits 106, the sampling of the parameter may be timed to coincide with a period of time just before the first boost module 106 (the boost module whose switching signal is not phase delayed) transitions from the discharge mode of the boost inductor to the charge mode. In this way, fewer transients may be detected.

Finally, as a load protection scheme, at least some of the embodiments of the invention may implement a system whereby switching signals to the boost modules 106 may be turned off if the input voltage takes an unexpectedly high spike. In particular, the DSP 108 may produce a $V_{limit}$ analog output signal whose amplitude represents a maximum limit of the source voltage, given typical power line fluctuations. This upper limit voltage may be compared to the actual rectified input voltage by a comparator 110. If the peak voltage experienced in the rectified input voltage exceeds the limit calculated an output by the DSP 108, the comparator 110 may drive an asserted state to a digital input of the digital signal processor 108. In response, the production of switching signals to the boost modules 106 may cease. As implied by the drawing of FIG. 3, this may be accomplished external to the digital signal processor for safety reasons, but this same logic implementation may be implemented within the digital signal processor without departing from the scope and spirit of the invention.

The above discussion is meant to be illustrative of the principles and various embodiments of the present invention. Numerous variations and modifications will become apparent to those skilled in the art once the above disclosure is fully appreciated. For example, in some embodiments, the digital signal processor 108 used may be a Texas Instruments part No. TMS32F2407. Other digital signal processors, however, could be equivalently used. It is intended that the following claims be interpreted to embrace all such variations and modifications.

What is claimed is:

1. A method of controlling a switching power supply comprising:

sampling a plurality of values of an output voltage of the power supply during a previous half cycle of an input voltage, and calculating an average output voltage;

sampling a plurality of values of an output current of the power supply during the previous half cycle of the input voltage, and calculating an average output current;

calculating the power provided by the power supply over the previous half cycle using the average output voltage and average output current; and adjusting duty cycle of a switching signal applied to a boost circuit in a subsequent half cycle of the input voltage using, in part, the calculated power provided to a load during the previous half cycle of the input voltage.

2. The method as defined in claim 1 further comprising sampling using a digital signal processor.

3. The method as defined in claim 2 wherein calculating further comprises:

calculating the average value of the output voltage using the digital signal processor;

calculating the average value of the output current using the digital signal processor; and calculating the power provided using the digital signal processor.

4. The method as defined in claim 1 wherein sampling further comprises aligning the sampling with the boost circuit switching signals.

5. The method as defined in claim 4 further comprising sampling proximate in time to the end of a discharge phase of the boost circuit.

6. The method as defined in claim 1 further comprising adjusting the boost circuit switching signals based, in part, on an output voltage error term.

7. The method as defined in claim 6 further comprising adjusting the boost circuit switching signals at substantially each zero crossing of the input voltage.

8. The method as defined in claim 1 further comprising operating the power supply in a discontinuous current mode.

9. The method as defined in claim 8 further comprising adjusting the boost circuit switching signals at substantially each zero crossing of the input voltage.

10. A switching power supply comprising:

a rectifying bridge coupled to an alternating current input power source, wherein the rectifying bridge produces a rectified input voltage;

a boost circuit coupled to the rectifying bridge, the boost circuit converts the rectified input voltage to an output voltage;

a digital signal processor coupled to the rectified input voltage, the output voltage, and a signal indicative of output current, and wherein the digital signal processor produces a boost control signal coupled to the boost circuit; and wherein the digital signal processor calculates power delivered to a load coupled to the power supply using the output voltage and output current over a previous half cycle of the Input power source, and wherein the digital signal processor adjusts a duty cycle of the boost control signal applied to the plurality of boost circuits during a subsequent half cycle using the calculated power delivered during the previous half cycle.

11. The switching power supply as defined in claim 10 further comprising:

a plurality of boost circuits: and wherein the digital signal processor selectively utilizes the plurality of boost circuits based on an amount of power required by the load.

12. The switching power supply as defined in claim 11 wherein the digital signal processor ceases using one of the plurality of boost circuits as the amount of power required by the load diminishes, and further wherein the digital signal processor adjusts the phase of the remaining boost control signals.

13. The switching power supply as defined in claim 10 wherein the digital signal processor adjusts the duty cycle of the boost signals based, in part, on a difference between the output voltage and an output voltage set point, and wherein the digital signal processor adjusts the duty cycle at approximately twice a frequency of the input power source.

14. The switching power supply as defined in claim 10 wherein the digital signal processor synchronizes sampling with the boost control signals.

15. The switching power supply as defined in claim 14 wherein the digital signal processor samples during a discharge cycle.

16. A method comprising:

determining a direct current output voltage error of a boost circuit of a switching power supply by:

obtaining a plurality of samples of the direct current output voltage over a previous half cycle of an alternating current input power source;

calculating an average direct current output voltage using the plurality of samples of the direct current output voltage; and calculating the direct current output voltage error using the average direct current output voltage and an output voltage set point;

applying, at approximately twice the frequency of the alternating current input power source, a correction to switching signals applied to the boost circuit of the switching power supply based on the direct current output voltage error.

17. The method as defined in claim 16 further comprising:

obtaining a plurality of samples of a signal representing output current over the previous half cycle;

calculating an amount of power delivered during the previous half cycle using the average direct current output voltage and the plurality of samples of the signal representing output current; and applying an additional correction to the switching signals applied to the boost circuit of the switching power supply in a subsequent half cycle using the calculated power delivered in the previous half cycle.

18. A switching power supply comprising:

a means for rectifying an alternating current input source to produce a direct current signal;

a means for boosting the direct current signal to an output voltage coupled to the means for rectifying;

a means for producing a boost control signal coupled to the means for boosting; and wherein the means for producing a boost control signal calculates a power delivered to a load coupled to the power supply using the output voltage and an output current over a previous half cycle of the input source, and wherein the means for producing a boost control signal adjusts a duty cycle of a boost control signal applied to the means for boosting during a subsequent half cycle using the calculated power delivered during the previous half cycle of the input power source.

19. The switching power supply as defined in claim 18 further comprising:

a plurality of means for boosting; and wherein the means for producing a plurality of boost control signals selectively utilizes the plurality of means for boosting based on an amount of power required by the load.

20. The switching power supply as defined in claim 19 wherein the means for producing a plurality of boost control signals ceases using one of the plurality of means for boosting as the amount of power required by the load diminishes, and further adjusts the phase of the remaining boost control signals.

21. The switching power supply as defined in claim 18 wherein the means for producing a plurality of boost control signals adjusts the duty cycle of the boost signals based, in part, on a difference between the output voltage and an output voltage set point, and wherein the means for producing a plurality of boost control signals makes the adjustment at approximately twice a frequency of the input power source.

22. The switching power supply as defined in claim 18 wherein the means for producing a plurality of boost control signals synchronizes sampling with the boost control signals.

23. The switching power supply as defined in claim 22 wherein the means for producing a plurality of boost control signals samples during a discharge cycle of the boost inductor.

* * * * *